United States Patent [19]

Hirai et al.

[11] Patent Number: 4,469,780

[45] Date of Patent: Sep. 4, 1984

[54] COLOR IMAGE FORMING PROCESS

[75] Inventors: Hiroyuki Hirai; Koichi Nakamura; Haruhiko Iwano, all of Kanagawa, Japan

[73] Assignee: Fuji Photo Film Co., Ltd., Kanagawa, Japan

[21] Appl. No.: 461,430

[22] Filed: Jan. 27, 1983

[30] Foreign Application Priority Data

Jan. 27, 1982 [JP] Japan ..... 57-11176
Feb. 10, 1982 [JP] Japan ..... 57-20046
Feb. 16, 1982 [JP] Japan ..... 57-23140

[51] Int. Cl.[3] ..... G03C 7/40; G03C 5/24; G03C 5/40; G03C 11/00

[52] U.S. Cl. ..... 430/373; 430/432; 430/454; 430/463

[58] Field of Search ..... 430/463, 373, 432, 454

[56] References Cited

U.S. PATENT DOCUMENTS 3,649,277 3/1972 Shibaoka et al. ..... 430/463
3,705,036 12/1972 Amano et al. ..... 430/372
3,765,891 10/1973 Travis ..... 430/373
4,057,427 11/1977 Enriquez ..... 430/373
4,062,684 12/1977 Hara et al. ..... 430/373
4,113,490 9/1978 Fujiwhara et al. ..... 430/373
4,336,324 6/1982 Koboshi et al. ..... 430/463

*Primary Examiner*—Mary F. Downey
*Attorney, Agent, or Firm*—Sughrue, Mion, Zinn, Macpeak and Seas

[57] ABSTRACT

A process for forming a color image is disclosed. The process involves providing a color light-sensitive photographic material and imagewise exposing the material. The latent images within the exposed material are then developed and subjected to intensification processing. Thereafter, the material is subjected to treatment with a dilute buffer solution having a pH adjusted within the range of 2 to 7. The process allows for the elimination of the washing step conventionally used in processing photographic materials. Furthermore, the process provides color images having a reduced amount of staining and a large intensification factor while utilizing color photographic materials containing an extremely small amount of silver.

17 Claims, No Drawings

COLOR IMAGE FORMING PROCESS

FIELD OF THE INVENTION

This invention relates to a process for forming a color image which can inhibit stains from occurring without including the washing step.

BACKGROUND OF THE INVENTION

In recent years, there has been a considerable concern with respect to making frugal use of washing water used in the photographic processing process since the cost of water supplied by cities has increased and further attempts to eliminate the discharge of waste water have been very expensive. In addition, the drastic increase of petroleum rates has caused an economic problem with respect to heating washing water. However, it has been impossible to remove the washing step from the usual processing process of conventional photographic materials. This is because the removal of the washing step causes a problem in that the processing reagents included in photographic materials are separated therefrom onto the surfaces thereof causing stains and changing the color of the silver images. Accordingly, the silver images may lose their colors, or the dye images may change their colors or lose colors.

The removal of a fixing step (which, in case of color photographic materials, corresponds to both the bleaching and fixing steps, that is, a desilvering step), though it is convenient for making the photographic processing process simple and rapid, is not desirable because it causes an increase in staining. The stains are mainly comprised of silver stain and color stain. In the above-described case, both silver stains and color stains are increased. In other words, stains can be removed by fixation in the case of black-and-white photographic materials. However, color stains cannot be removed by desilvering though silver stain can be reduced thereby in the case of color photographic materials.

If both the washing step and the fixing or the desilvering step are omitted staining will be inevitably increased. When usual photographic materials are subjected to usual processings not including the use of any intensifying baths, stain generation cannot be prevented even by processing with a low pH bath.

However, with photographic materials having low silver halide contents, it is known that the fixing step or the bleach-fix step can be omitted. These steps are generally omitted because silver stain is generated to a small extent due to low silver content. In the case of color photographic materials, however, color stain is generated unless thorough washing is carried out. For instance, though color photographic materials that do not require washing, such as Linagraph 705, are on the market, increase in stain over time is observed with such materials.

SUMMARY OF THE INVENTION

Therefore, a first object of this invention is to provide a process for forming color images in which the washing step can be omitted.

A second object of this invention is to provide intensified color images having a reduced amount of staining and a large intensification factor using a color photographic material containing an extremely small amount of silver.

A third object of this invention is to provide a process for forming intensified color images in which the number of processing baths is reduced.

As a result of examining various processes, it has now been found that when photographic materials receive an intensifying treatment the above-described stains can be effectively prevented from being generated by an after-treatment using a low pH bath.

That is, the above-described objects of this invention are attained by an image forming process in which after imagewise exposing silver halide color photographic material, the material is color developed and intensification-processed, and then treated with a dilute buffer solution adjusted to pH 2 to 7, preferably pH 2 to 5.

DETAILED DESCRIPTION OF THE INVENTION

It is contrary to common expectation that an after-treatment using a low pH bath can prevent stains from being caused in photographic materials having received an intensifying processing.

Hitherto, various methods for intensification of images in silver halide photographic materials by development and intensification processings have been known. For example, a method comprising oxidation of a paraphenylenediamine series color developing agent through decomposition of hydrogen peroxide on the catalyst surface in the presence of a color forming agent, and subsequent dye formation through the coupling with the color forming agent (such a phenomenon is called color intensification) is described in, for example, Friedman, History of Color Photography, 2nd Ed., p. 406 (1956). Various other photographic methods utilizing the decomposition of peroxides on noble metal surfaces are described in German Patent Application (OLS) Nos. 1,813,920 (corresponding to U.S. Pat. No. 3,674,490, hereinafter the same), 1,950,102, 1,961,029 (U.S. Pat. No. 3,684,511), 2,044,833, 2,044,993 (U.S. Pat. No. 3,761,265), 2,056,360 (U.S. Pat. No. 3,776,630), 2,056,359 and 2,120,091, and so on. On the other hand, color intensifying methods using cobalt complex salts on noble metal surfaces are described in, for example, Japanese Patent Application (OPI) Nos. 9728/73 (U.S. Pat. No. 3,834,907), 9729/73 (U.S. Pat. No. 3,765,891), 48130/73 (U.S. Pat. No. 3,822,129), 84229/74, 84240/74 (U.S. Pat. No. 3,902,905), 97614/74 (U.S. Pat. No. 3,847,619), 102340/74 (U.S. Pat. No. 3,923,511), 102314/74 and so on (the term "OPI" as used herein refers to a "published unexamined Japanese patent application").

Further, color intensifying methods using halogenous acids such as chlorous acid and the like are described in Japanese Patent Application (OPI) Nos. 53826/76 and 13335/77 (U.S. Pat. No. 4,062,684). Furthermore, color intensifying methods using iodoso compounds such as iodosobenzoic acid and the like are described in Japanese Patent Application (OPI) No. 73731/77.

Compounds having intensifying effects, such as the above-described peroxides, halogenous acids, iodoso compounds and cobalt (III) complex compounds, are called intensifiers, and processing baths containing these intensifiers are called intensifying baths.

Techniques of intensifying color images by taking advantage of catalytic actions of peroxy compounds or cobalt (III) complexes are known representatives of color intensifying techniques. In particular, hydrogen peroxide intensification is considered to be best from the viewpoint of intensification rate. These color intensifying methods are known to consist in the redox reaction of intensifiers with color developing agents which takes place with high efficiency on a silver nucleus catalyst, which is produced as developed silver by imagewise exposure and subsequent development of silver halide photographic materials, to produce oxidation products of the developing agents leading to formation of dye images of high densities and therethrough to intensification of the images. Namely, a processing method in which a color photographic material is dipped in an intensifying bath after color development, or it is dipped in a color developing solution after black-and-white development and then dipped in an intensifying bath and thereby firstly latent image is grown by the development and secondly in the intensifying bath the redox reaction of the color developing agent, which is held in constituent layers of the photographic material by color development or dipping in the color developing solution, with the intensifier takes place on developed silver nuclei to intensify image density, is generally referred to as an intensification processing.

In this invention, color development- and intensification-processing is preferably conducted using a color developing agent and at least one intensifier selected from the group consisting of peroxides, halogenous acids, iodoso compounds and cobalt (III) complexes and, optionally, a color forming agent. It is more preferable that such processing be conducted using a combined developing and intensifying bath containing hydrogen peroxide or a compound capable of releasing hydrogen peroxide and a developing agent and that not containing substantially any bromide ion or any iodide ion as described below.

In order to conduct image intensification with high efficiency, it is necessary that a developing agent be held in constituent layers of a photographic material in quantity and therethrough carried in an intensifying bath and, further, it is also necessary that the developing agent be rapidly oxidized with the intensifier on the silver nucleus catalyst before it diffuses into the intensifying bath from the constituent layers of the photographic material. As a means for satisfying these necessities it is possible to use a method which involves an oleophilic developing agent in a developing solution as described in U.S. Pat. No. 3,816,134 and Japanese Patent Application (OPI) No. 30333/78. Further, techniques for inhibiting intensification fog without lowering the activity of the catalytic nuclei are described in Japanese Patent Application (OPI) Nos. 13335/77 (U.S. Pat. Nos. 4,062,684) and 19829/78. Thus, mingling of some components of a developing solution in an intensifying bath is a fundamental problem of the image intensification method, and it is an unavoidable problem that intensification activity is lowered by mingling with an intensification inhibiting substance and the capacity of an intensifying bath is changed by mingling with a developing agent. In addition, the image intensification method is not desirable because the number of processing steps is increased by one or more, compared with conventional processing steps, since a photographic material must go through processing in an intensifying bath, that is, this method is contrary to the idea of simplifying an image forming process.

The possibility of carrying out development and intensification at the same time is presented in German Pat. No. 1,813,920, Japanese Patent Application (OPI) Nos. 13335/77 (U.S. Pat. No. 4,062,684) and 127555/80, and so on, wherein development and intensification are carried out at the same time in the same bath using hydrogen peroxide. However, a combined developing and intensifying effect can hardly be acquired in a low silver content photographic material simply by adding hydrogen peroxide to a conventional color developing solution due to the presence of potassium bromide in the color developing solution (usually several hundreds mg/l of potassium bromide is added thereto). A certain method which solves this problem and provides a color intensified image with a high intensification rate and reduced fog using a very low silver content color photographic material and that using the reduced number of processing baths has been invented as disclosed in Japanese Patent Application No. 117973/81.

That is, such an invention consists in an image forming process which includes the step of subjecting an imagewise exposed color photographic material to the color development processing using a combined developing and intensifying bath, which contains hydrogen peroxide or a compound capable of releasing hydrogen peroxide and a color developing agent and that, does not contain substantially both bromide ion and iodide ion, in the presence of such a compound as to react with or to be adsorbed by silver halide, for example, a nitrogen-containing heterocyclic compound.

Though such a process was an important advance in the field, it tends to cause undesirable coloration in non-image areas. Therefore, improvement with respect to this point is essential to such a process.

On the other hand, the above-described image forming process has advantages in that the silver content can be reduced to a great extent and the number of processing baths can be reduced, that is, a bleaching bath, a fixing bath and, optionally, water washing can be omitted, though it is attended with the above-described disadvantage.

However, the above referred to disadvantage can be removed by applying the after-treatment processing of this invention. That is, when color intensified images provided by using the above-described combined developing and intensifying bath are processed with the dilute buffer solution of this invention, generation of color stain can be prevented even if water washing is omitted.

Buffers which can be employed in this invention include certain known ones. Specifically, monopotassium phosphate-dipotassium phosphate, sodium citrate-hydrochloric acid, sodium citrate-sodium hydroxide, succinic acid-borax, acetic acid-sodium acetate, tartaric acid-sodium tartarate, borax-boric acid, sodium diethylbarbiturate-hydrochloric acid, glycine-sodium chloride-hydrochloric acid, lactic acid-sodium lactate, Britton-Robinson regional buffer solution and so on can be employed. The concentration of such a buffer varies depending on the kind of the buffer used, but generally ranges from $1\times10^{-2}$ mole to 1 mole per liter. When the washing step to follow the treatment with a low pH bath is omitted, it is desirable to control the concentration of the buffer as low as possible, for example, within the range of $1\times10^{-2}$ to $1\times10^{-1}$ mole per liter, from the standpoint of minimizing the generation of stain due to adhesion of the salts to the sensitive material.

The pH range of the buffer solution is 2 to 7. Especially good results are obtained when the pH of the buffer solution is within the range of 2 to 5.

The dilute buffer solution adjusted to pH 2 to 7 which is to be employed in this invention may additionally contain a sulfite, a bisulfite, a metabisulfite, an adduct of formaldehyde and a bisulfite, a thiosulfate and a thiocyanate.

When a sulfite and a bisulfite or a metabisulfite are used in the buffer solution, other buffers may not be used in combination because these salts have buffering ability. A desirable addition amount of these salts is within the range of from $1\times10^{-2}$ to 1 mole, more desirably $1\times10^{-2}$ to $1\times10^{-1}$ mole per 1 liter of the buffer solution.

When a thiosulfate, a thiocyanate and an adduct of formaldehyde and a bisulfite are used in the buffer solution, a desirable addition amount of these additives ranges from $1\times10^{-3}$ to $1\times10^{-1}$ mole per 1 liter of the buffer solution.

The buffer solution may optionally contain a chelating agent or a water softening agent, such as an aminopolycarboxylic acid like ethylenediaminetetraacetic acid or the salts thereof or organic phosphoric acid like 1-hydroxyethane-1,1-diphosphoric acid or the salt thereof; a hardener like formalin; and an organic solvent such as ethanol, methanol, acetonitrile, acetone or the like. Further, a surface active agent, a defoaming agent and so on may be contained therein.

The temperature of the buffer solution of this invention is usually selected from the range of 18° C. to 50° C. However, temperatures lower than 18° C. or those higher than 50° C. may be adopted.

When a color development process using a combined developing and intensifying bath as described above is used, it is preferable that the buffer solution includes a compound capable of depressing the intensifying activity of silver halide fog nuclei and/or a fluorescent brightening agent. The inclusion of the compound capable of depressing the intensifying activity of silver halide fog nuclei and/or the brightening agent in the buffer solution of this invention contributes to effectively prevent generation of color stain. In addition, such inclusion can provide images of high quality, for example, images which can be used as a color print having a white reflex type support in which stain balance among three colors (red, green and blue) is usually evaluated to a level on the order of 0.01.

Examples of compounds capable of depressing the intensifying activity of silver halide fog nuclei which can be employed in this invention include halides; azoles such as benzothiazolium salts, nitroindazoles, triazoles, benzotriazoles and benzimidazoles (especially nitro or halogen substituted ones); heterocyclic mercapto compounds such as mercaptothiazoles, mercaptobenzothiazoles, mercaptobenzimidazoles, mercaptothiadiazoles, mercaptotetrazoles (especially 1-phenyl-5-mercaptotetrazole), and mercaptopyrimidines; the above-described heterocyclic mercapto compounds having further water-soluble groups like carboxyl or sulfonic acid groups; other mercapto compounds, e.g., mercapto carboxylic acids and mercaptoalkanols; thioether compounds; thiourea compounds; sulfur-containing amino acids like cystine and cysteine; thioketo compounds like oxazolinethione; azaindenes like tetraazaindenes; benzenethiosulfonic acids; benzenesulfinic acids; and so on. Among the above compounds, iodides, heterocyclic mercapto compounds, thioether compounds and thiourea compounds are preferable.

Specific examples of representative intensifying activity depressing compounds which can be employed in this invention are illustrated below.

KI (1)

KBr (2)

$(C_2H_5)_4N^{\oplus}I^{\ominus}$ (3)

(4)

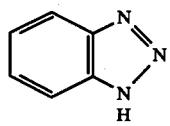

(5)

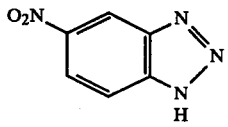

(6)

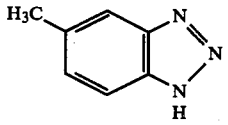

(7)

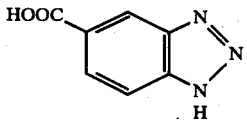

(8)

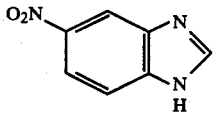

(9)

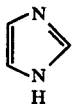

(10)

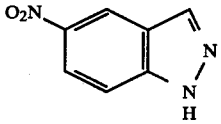

(11)

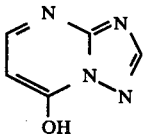

(12)

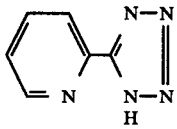

(13)

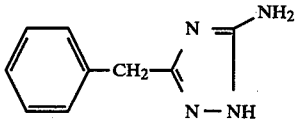

(14)

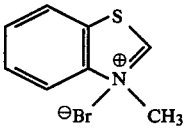

-continued
(15)
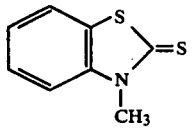
(16)
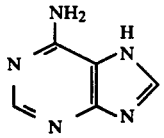
(17)
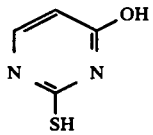
(18)
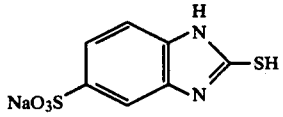
(19)
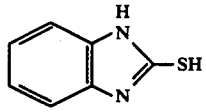
(20)
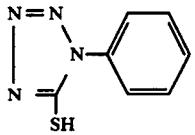
(21)
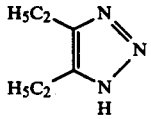
(22)
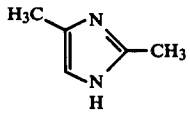
(23)
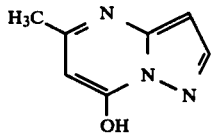
(24)
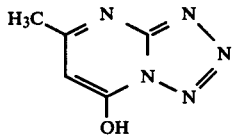
(25)
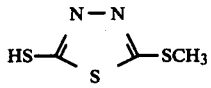
(26)
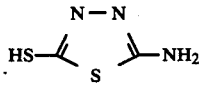
-continued
(27)
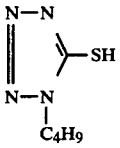
(28)
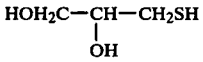
(29)
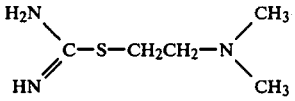
(30)
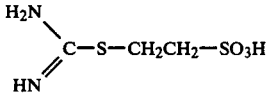
(31)
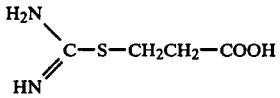
(32)
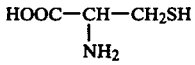
(33)
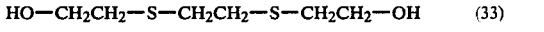
(34)
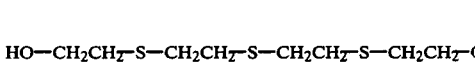
(35)
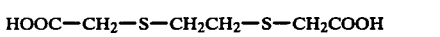
(36)
(37)
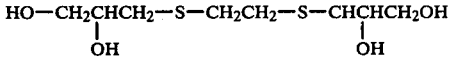
(38)
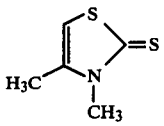
(39)
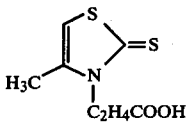
(40)
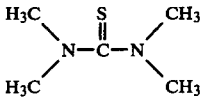
(41)
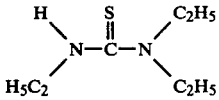
(42)
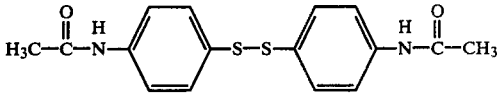

Among the above-illustrated compounds are included those which are effective when added as "a nitrogen-containing heterocyclic compound" to a combined developing and intensifying bath (the first bath) of this invention. However, addition of the same compound to both the first bath and the second bath of this invention is not always highly effective. For instance, bromides and iodides should be used only in the second bath.

An addition amount of each of the above-described intensifying activity depressing compounds to the after-treating bath varies depending upon the kind of silver halide contained in a silver halide photographic material used, the coverage of silver therein, and its own capacity regarding depression of intensifying activity and, therefore, it is not limited to any particular values. However, it is desirable to add such a compound in an amount more than the amount employed in the combined developing and intensifying bath by a factor of 10. The bath is disclosed in Japanese Patent Application No. 117973/81. If the intensifying activity depressing compound is added to the combined developing and intensifying bath in the same amount as to be used in the after-treating bath of this invention, the compound substantially ruins the combined bath and only color images having a very low intensification rate can be obtained.

On the other hand, in this invention the intensifying activity depressing compound is used in the treatment carried out after the formation of intensified color image and, therefore, the compound can be used in a large amount. Specifically, the intensifying activity depressing compound is added to the after-treating bath in an amount ranging from $1\times10^{-5}$ to $2\times10^{-1}$ mole/l, preferably from $1\times10^{-4}$ to $1\times10^{-1}$ mole/l and more preferably $1\times10^{-3}$ to $5\times10^{-2}$ mole/l.

This invention is based on the finding that in case of the process including the combined developing and intensifying step, only when the intensifying activity depressing compound is employed after this step staining can be inhibited from occurring without lowering the intensifying activity. This finding has considerable significance.

A buffer solution to which the intensifying activity depressing compound is to be added may contain a sulfite, a bisulfite, a metabisulfite, an adduct of formaldehyde and a bisulfite, a thiosulfate and/or a thiocyanate.

The buffer solution containing the intensifying activity depressing compound of this invention can be used generally in a pH range of 2 to 7, preferably 3 to 7, and more preferably 4 to 7.

Suitable fluorescent brightening agents which can be employed in this invention include those of the diaminostilbene type, those of the distyrylbenzene type, those of the benzidine type, those of the diaminocarbazole type, those of the triazole type, those of the imidazole, thiazole and oxazole types, those of the imidazolone type, those of the dihydropyridine type, those of the coumarin and carbostyryl types, those of the diaminodibenzothiophene dioxide type, those of the diaminofluorene type, those of the oxacyanine type, those of the aminonaphthalimide type, those of the pyrazoline type, and those of the oxadiazole type.

Typical representative fluorescent brightening agents to be used in this invention are illustrated below:

(43)

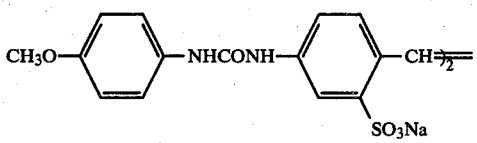

(44)

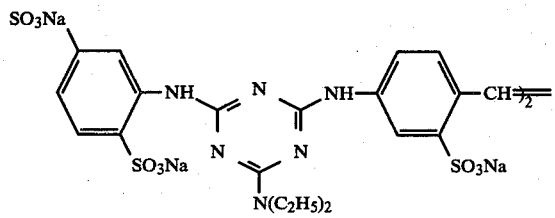

(45)

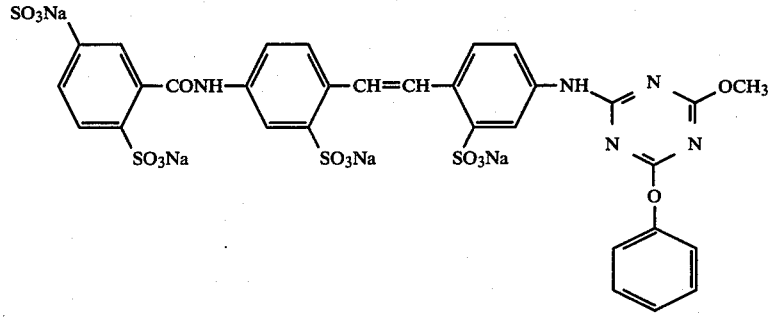

(46)

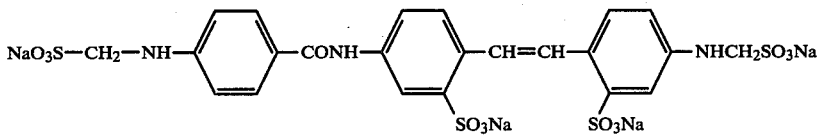

-continued
(47)
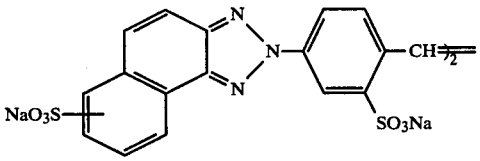
(48)
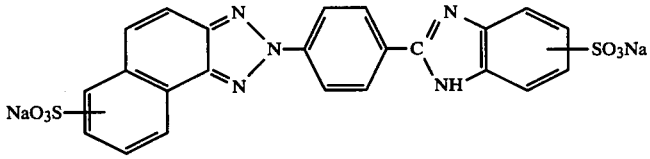
(49)
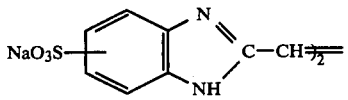
(50)
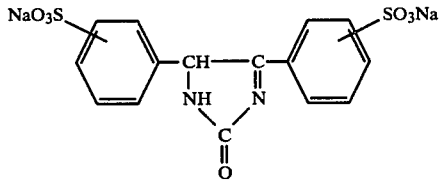
(51)
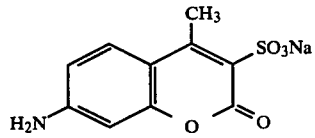
(52)
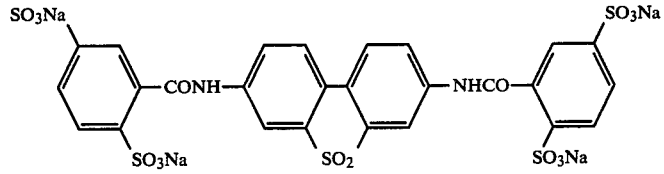
(53)
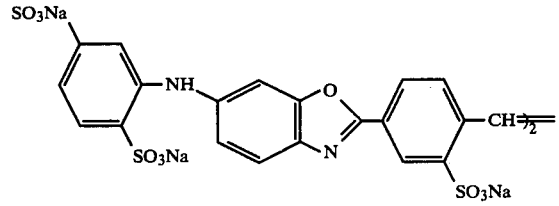
(54)
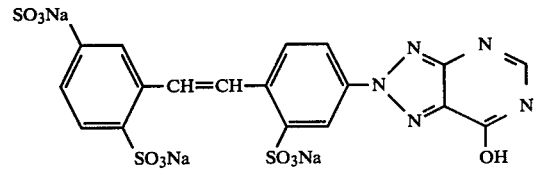
(55)
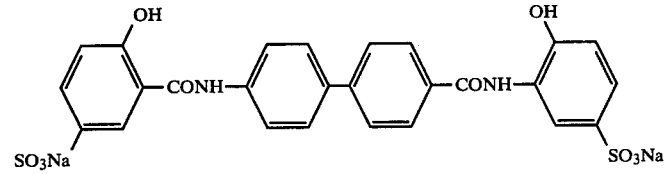
The amount of each of the above-described brightening agent which is added to a buffer solution varies depending on the type of agent. A suggested concentration is from $5\times10^{-5}$ to $5\times10^{-2}$ mole of brightening agent, per liter of a buffer solution. Especially good results are obtained when the brightening agent is added in concentrations ranging from $1\times10^{-4}$ to $2\times10^{-2}$ mole per liter of the buffer solution.

In addition, brightening agents described in U.S. Pat. Nos. 2,632,701, 3,269,840 and 3,359,102, British Pat. Nos. 852,075 and 1,319,763, Research Disclosure, Vol. 176, No. 17643, page 24, the left column, from 9th line to 36th line, head Brightness (December, 1978), Kunio Yagi, Zen-ichi Yoshida and Riichi Ohata, Keiko (Riron, Sokutei, Oyo), (which means Fluorescence (Theory, Measurement and Application)), pp. 251-273 (1958), and so on can also be employed in this invention.

A buffer solution to which a brightening agent is to be added may additionally contain a compound capable of depressing the intensifying activities of the fog nuclei and catalytically acting silver nuclei and may further contain a sulfite, a bisulfite, a metabisulfite, an adduct of formaldehyde and a bisulfite, a thiosulfate, and a thiocyanate.

The processing solution containing the brightening agent of this invention can be used generally in a pH range of 2 to 7, preferably 3 to 7, particularly 4 to 7.

Nitrogen-containing heterocyclic compounds which can be employed in this invention may be used either individually or in a combination of two or more thereof. They are incorporated in a developing and intensifying solution and/or a silver halide photographic material.

Preferable nitrogen-containing heterocyclic compounds which can be employed in this invention are nitrogen-containing 5- or 6-membered heterocyclic compounds, condensed rings thereof, and nitrogen-containing heterocyclic compounds represented by the following general formulae (I) and (II), respectively:

(I)

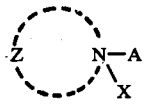

(II)

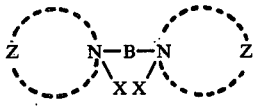

wherein A represents a substituted or unsubstituted alkyl group, an alkenyl group, an alkinyl group, an aralkyl group, an alicyclic hydrocarbon group, or a substituted or unsubstituted aryl group; B represents a substituted or unsubstituted divalent hydrocarbon residue, preferably $-(CH_2)_n-$, $-CH_2O-(CH_2)_n-O-CH_2-$,

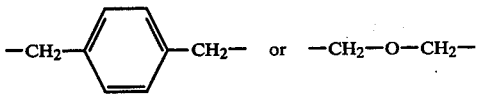

(wherein n represents an integer of 1 to 12); X represents an anion other than iodine ion; and Z represents non-metal atoms necessary to form a heterocyclic ring together with nitrogen.

More preferable examples of the above-described nitrogen-containing 5- or 6-membered heterocyclic compounds and the condensed rings thereof can be represented by the following general formulae (III) to (XIV):

(III)

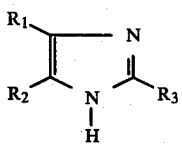

(IV)

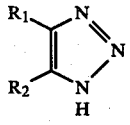

(V)

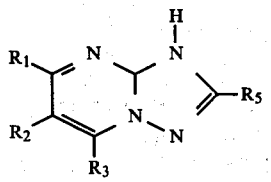

(VI)

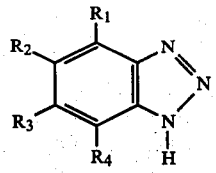

(VII)

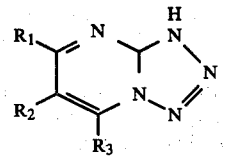

(VIII)

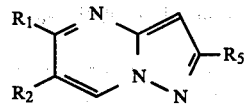

(IX)

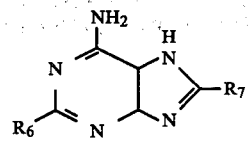

(X)

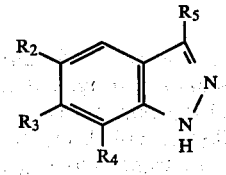

(XI)

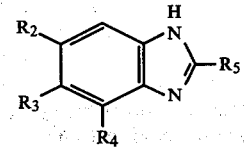

(XII)

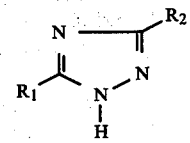

-continued

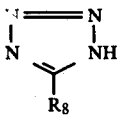
(XIII)

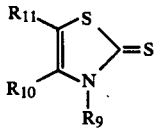
(XIV)

In the general formulae (III) to (XIV), $R_1$, $R_2$, $R_3$ and $R_4$ each represents a hydrogen atom, an alkyl group, an aralkyl group, an alkenyl group, an alkoxy group, an aryl group, —NRR', —COOR, —$SO_3M$, —CONRR', —$NHSO_2R$, —$SO_2NRR'$, —$NO_2$, a halogen atom, —CN or —OH (wherein R and R' each represents a hydrogen atom, an alkyl group, an aryl group or an aralkyl group; and M represents a hydrogen atom or an alkali metal atom). On the occasion that both $R_1$ and $R_2$ are alkyl groups, they may optionally combine with each other and form an aliphatic carbon ring.

The substituent $R_5$ represents a hydrogen atom, an alkyl group containing 1 to 5 carbon atoms, or —S—R'' (wherein R'' represents a hydrogen atom, an alkyl group, an aryl group or an aralkyl group). The substituent $R_6$ represents a hydrogen atom or an alkyl group. The substituent $R_7$ represents a hydrogen atom, an alkyl group or an aryl group. The substituent $R_8$ represents an alkyl group, an aryl group, a benzyl group or a pyridyl group. The substituent $R_9$ represents an alkyl group, an alkenyl group or an aryl group. The substituents $R_{10}$ and $R_{11}$ each represents an alkyl group, an alkenyl group or an aryl group, or when both of them are alkyl groups they may optionally combine with each other and form an aromatic ring.

In addition, nitrogen-containing heterocyclic compounds which have a mercapto group in their individual molecules can be used in this invention. Preferable examples of such compounds have the following general formula (XV):

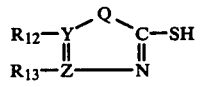
(XV)

wherein Q represents an oxygen atom, a sulfur atom or —NR''' (wherein R''' represents a hydrogen atom, an alkyl group, an unsaturated alkyl group, or a substituted or unsubstituted aryl or aralkyl group); Y and Z each represents a carbon atoms or a nitrogen atom; and $R_{12}$ and $R_{13}$ each represents a hydrogen atom, an alkyl group, an unsaturated alkyl group, a substituted or unsubstituted aryl group, a substituted or unsubstituted aralkyl group, —SR'''' or —$NH_2$ (wherein R'''' represents a hydrogen atom, an alkyl group, an aryl group, an aralkyl group, an alkylcarboxylic acid or an alkali metal salt thereof, or an alkylsulfonic acid or an alkali metal salt thereof). Therein, when both Y and Z are carbon atoms, $R_{12}$ and $R_{13}$ may form a substituted or unsubstituted aromatic ring.

Specific examples of nitrogen-containing heterocyclic compounds which can be preferably employed in this invention are illustrated below.

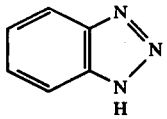
(1a)

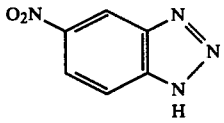
(2a)

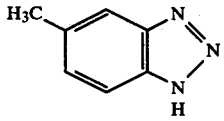
(3a)

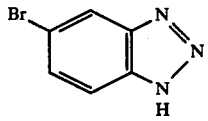
(4a)

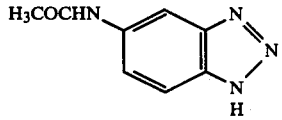
(5a)

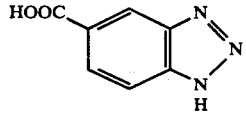
(6a)

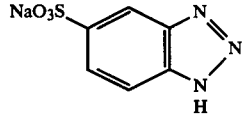
(7a)

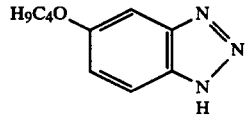
(8a)

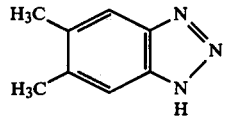
(9a)

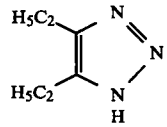
(10a)

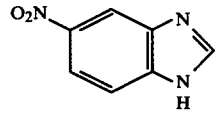
(11a)

-continued
(12a)
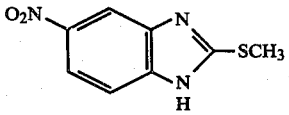
(13a)
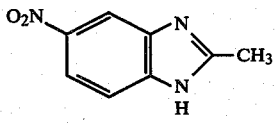
(14a)
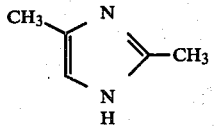
(15a)
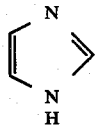
(16a)
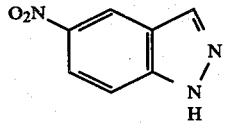
(17a)
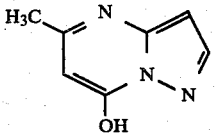
(18a)
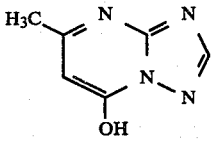
(19a)
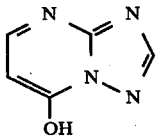
(20a)
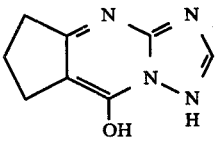
(21a)
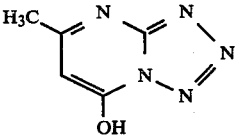
(22a)
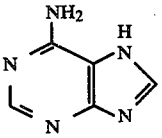
-continued
(23a)
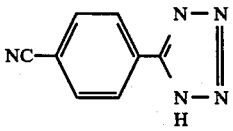
(24a)
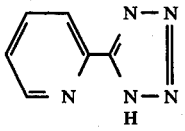
(25a)
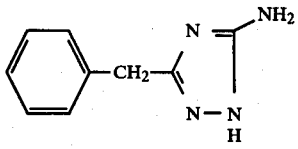
(26a)
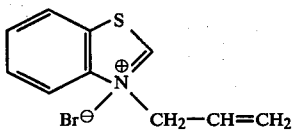
(27a)
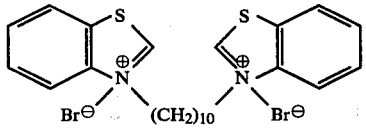
(28a)
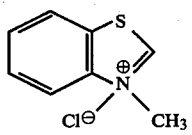
(29a)
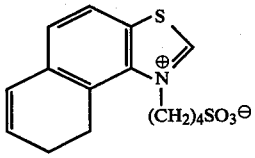
(30a)
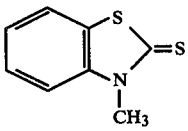
(31a)
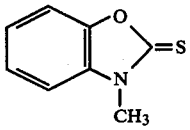
(32a)
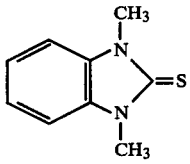

-continued
(33a)
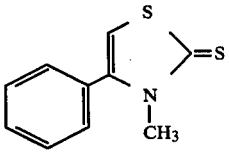
(34a)
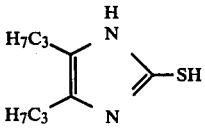
(35a)
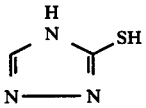
(36a)
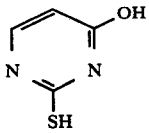
(37a)
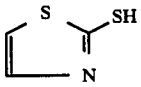
(38a)
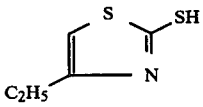
(39a)
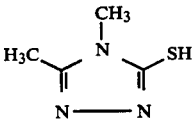
(40a)
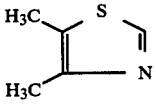
(41a)
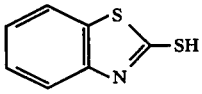
(42a)
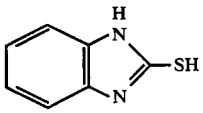
(43a)
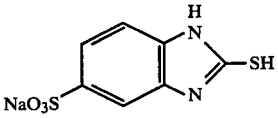
(44a)
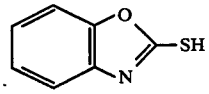
-continued
(45a)
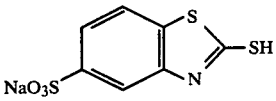
(46a)
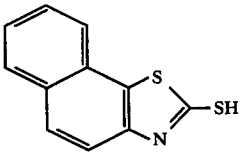
(47a)
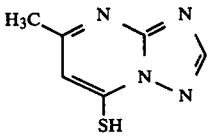
(48a)
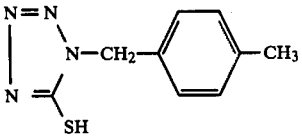
(49a)
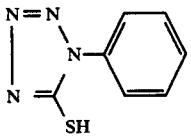
(50a)
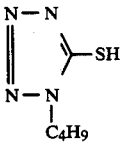
(51a)
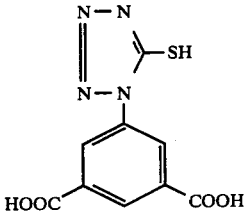
(52a)
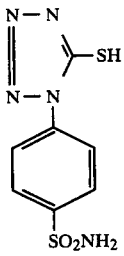

-continued

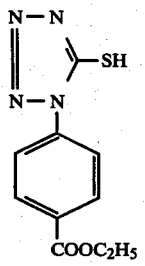

(53a)

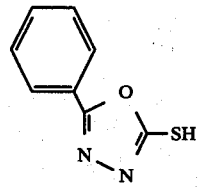

(54a)

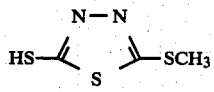

(55a)

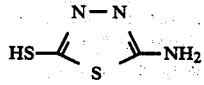

(56a)

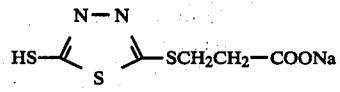

(57a)

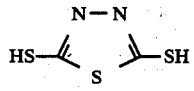

(58a)

The above-illustrated nitrogen-containing heterocyclic compounds have a fog restraining effect and may be added to a developing and intensifying solution in an amount which varies depending on the kind of silver halide contained in a photographic element used, the coverage of silver therein, and its own capacity regarding fog restraint. Therefore, the amount added is not limited to any particular values. However, it is preferable to add such a compound in an amount less than those used in conventional developing solutions and intensifying solutions by a factor of 10. Specifically, it is used in a developing and intensifying solution in a concentration ranging from $1\times10^{-7}$ to $1\times10^{-2}$ mole/l, preferably from $1\times10^{-6}$ to $1\times10^{-3}$ mole/l, and more preferably from $3\times10^{-6}$ to $1\times10^{-4}$ mole/l.

When such a heterocyclic compound is added to a silver halide photographic material, the coverage thereof is adjusted to the range of $10^{-8}$ to $10^{-2}$ mole/m$^2$, preferably the range of $10^{-7}$ to $10^{-3}$ mole/m$^2$.

Further, nitrogen-containing heterocyclic compounds described in the following known literatures can also be employed in this invention.

Examples of such compounds include nitrobenzimidazoles described in U.S. Pat. No. 2,496,940, British Pat. No. 403,789, U.S. Pat. Nos. 2,497,917 and 2,656,271, and so on; benzotriazoles described in Nippon Shashin Gakkaishi, Vol. 11, p. 48 (1948) (which is a bulletin published by Photographic Society of Japan); heterocyclic quaternary salts like benzothiazolium salts described in U.S. Pat. Nos. 2,131,038, 2,694,716 and 3,326,681, and so on; tetraazaindenes described in U.S. Pat. Nos. 2,444,605, 2,444,606 and 2,444,607, and so on; various heterocyclic compounds described in U.S. Pat. Nos. 2,173,628, 2,324,123 and 2,444,608, and so on; and others as described in Kagaku Shashin Binran, the Second Volume, page 119, Maruzen, Tokyo (1959) (which is a handbook of scientific photography).

Color developing agents which can be used in this invention include color developing agents of p-phenylenediamine derivative type; color developing agents of p-aminophenol derivatives converted to an onium salt form, as described in U.S. Pat. No. 3,791,827 and so on; developer dyes as described in U.S. Pat. No. 2,983,606 and so on; diffusible dye releasing (DDR) type redox compounds described in Japanese Patent Application (OPI) No. 33826/73; developing agents capable of reacting with amidorazone compounds, as described in Japanese Patent Publication No. 39165/73 and so on; reducing agents of the kind which themselves can form dyes or lakes by being oxidized (e.g., tetrazonium salts, 2,4-diaminophenol, α-nitroso-β-naphthol leuco pigments, etc.); reducing agents capable of forming colored image after oxidation described on pages 9 to 13 of Japanese Patent Application (OPI) No. 6338/72; and so on. These color developing agents which can be used in this invention are classified into several groups. One group includes developing agents that must be oxidized and couple with a color forming agent for dye formation. Another group includes those which themselves form dyes by oxidation. Still another group includes those which are colored in advance and converted to non-diffusible dyes by oxidation, and so on.

Representative examples of the color developing agents of the p-phenylenediamine derivative type include 2-amino-5-diethylaminotoluene hydrochloride; 2-amino-5-(N-ethyl-N-laurylamino)toluene; 4-[N-ethyl-N-(β-hydroxyethyl)amino]aniline sulfate; 2-methyl-4-[N-ethyl-N-(β-hydroxyethyl)amino]aniline sulfate; N-ethyl-N-(β-methanesulfonamidoethyl)-3-methyl-4-aminoaniline-sesquisulfate monohydrate described in U.S. Pat. No. 2,193,015; N-(2-amino-5-diethylaminophenylethyl)methanesulfonamidosulfate described in U.S. Pat. No. 2,592,364; N,N-dimethyl-p-phenylenediamine hydrochloride; 4-amino-3-methyl-N-ethyl-N-methoxyethylaniline, 4-amino-3-methyl-N-ethyl-N-β-ethoxyethylaniline, 4-amino-3-methyl-N-ethyl-N-β-butoxyethylaniline and the salts thereof (e.g., sulfates, hydrochlorides, sulfites, p-toluenesulfonates, etc.), as described in U.S. Pat. Nos. 3,656,950 and 3,698,525.

Those which are described in L.F.A. Mason, Photographic Processing Chemistry, pages 226–229, Focal Press, London (1966) can be also used.

There are color developing agents of the type which form dye images by themselves when oxidized, and color developing agents of the type which undergo complexation with metal salts when oxidized. Those which belong to these types of color developing agents are compounds described in British Pat. No. 1,210,417; tetrazonium salts described in U.S. Pat. No. 3,655,382; 2,4-diaminophenol, α-nitroso-β-naphthol and so on. These color developing agents are compounds of the kind which are quickly oxidized by intensifiers in the presenceof catalytic substances and, on the other hand, in the region any catalysts are not present which are oxidized with very slow rates, and constitute image forming elements by themselves or exhibit an image forming function in the oxidized condition when made to react with color forming agents. These color developing agents can also be used in this invention.

Generally, photographic materials contain silver salts in amounts corresponding to 3 to 10 g of silver per square meter, and print materials contain silver salts in amounts corresponding to about 1 to about 4 g of silver per square meter. However, photographic materials of this invention may have coverages of 1 g or less, particularly 0.5 g or less, of silver per square meter. In the case of multilayer photographic materials, a usable coverage of silver in each light-sensitive layer is 1 $g/m^2$ or less, particularly within the range of 1 $mg/m^2$ to 0.5 $g/m^2$.

The term color forming agent used in this invention means such a compound as to form a dye by reaction with an oxidized color developing agent, that is to say, a coupler.

Couplers which can be used in this invention include the following color forming couplers, that is, compounds which form color through the oxidative coupling reaction with aromatic primary amine developers (e.g., phenylenediamine derivatives, aminophenol derivatives, etc.) in the color development processing. Specific examples of useful color forming couplers include magenta couplers such as 5-pyrazolone couplers, pyrazolobenzimidazole couplers, cyanoacetylcumarone couplers and open chain acylacetonitrile couplers; yellow couplers such as acylacetamide couplers (e.g., benzoylacetanilides and pivaroylacetanilides); and cyan couplers such as naphthol couplers and phenol couplers. Preferred couplers are rendered non-diffusible by introduction of a hydrophobic group called a ballast group into their individual molecules or are converted to a polymer form. These couplers may be either 4-equivalent or 2-equivalent with respect to silver ions. In addition, colored couplers having a color correction effect, or couplers capable of releasing development inhibitors by the progress of development (so-called DIR couplers) may be used.

DIR couplers, colorless DIR couplers which form colorless compounds upon the coupling reaction and that release development inhibitors can also be used.

Two or more kinds of couplers may be incorporated in the same layer, and it is, of course, possible to incorporate the same compound into two or more of layers in order to fulfill requirements for characteristics of the photographic material.

The couplers are introduced into silver halide emulsion layers in known manners, for example, using the method described in U.S. Pat. No. 2,322,027, and so on. That is, the couplers are firstly dissolved in high boiling point solvents, such as alkylphthalates (e.g., dibutyl phthalate, dioctyl phthalate, etc.), phosphoric acid esters (e.g., diphenyl phosphate, triphenyl phosphate, tricresyl phosphate, dioctylbutyl phosphate, etc.), citric acid esters (e.g., tributyl acetylcitrate, etc.), benzoic acid esters (e.g., octylbenzoate, etc.), alkylamides (e.g., diethyllaurylamide, etc.), fatty acid esters (e.g., dibutoxyethylsuccinate, diethylazelate, etc.), trimesic acid esters (e.g., tributyltrimesate, etc.) and so on; or in organic solvents having boiling points of about 30° C. to 150° C., for example, lower alkyl acetates such as ethyl acetate, butyl acetate and the like, ethyl propionate, secondary butyl alcohol, methyl isobutyl ketone, $\beta$-ethoxyethylacetate, methyl cellosolve acetate, etc.; and then dispersed into hydrophilic colloids. Thereupon, the above-described high boiling point organic solvent and low boiling point organic solvent may be used in the form of a mixture.

The dispersing method utilizing polymers described in Japanese Patent Publication No. 39853/76 and Japanese Patent Application (OPI) No. 59943/76 (U.S. Pat. No. 4,214,047) can also be adopted.

When the couplers have acid groups like carboxylic acid and sulfonic acid, they are put in the form of aqueous alkaline solutions and introduced into hydrophilic colloids.

Color couplers have a very good effect when they are used in combinations selected so as to provide a medium scale image. Preferable cyan color couplers are those which form cyan dyes having their maximum absorption bands in the wavelength region of about 600 nm to about 720 nm, preferable magenta color couplers are those which form magenta dyes having their maximum absorption bands in the wavelength region of about 500 nm to about 580 nm, and preferable yellow color couplers are those which form yellow dyes having their maximum absorption bands in the wavelength region of about 400 nm to about 480 nm.

A silver halide emulsion is generally made by mixing a solution of a water-soluble silver salt (e.g., silver nitrate) with a solution of a water-soluble halogenide (e.g., potassium bromide) in the presence of a solution of a water-soluble polymer like gelatin. Suitable ones for such a silver halide include silver chloride, silver bromide and mixed silver halides such as silver chlorobromide, silver iodobromide, silver chloroiodobromide and the like. A preferable mean grain size of such silver halide grains (in the case of grains having a spherical or nearly spherical shape the grain size is represented by the diameter thereof, and in the case of cubic grains the grain size is represented by the length of its edge and that it is averaged using the projected area method) is $2\mu$ or less, particularly $0.4\mu$ or less. The distribution of the grain size may be either narrow or broad.

These silver halide grains may have any crystal form, such as a cubic form, an octahedral form, the mixed form thereof, or so on.

Further, two or more kinds of silver halide photographic emulsions made separately may be used in a mixed form.

Furthermore, the silver halide grain may have a uniform structure in every part from its surface part to its inner part, a layer structure that the core and the shell of the grain are different in kind, or the so-called conversion type structures as described in British Pat. No. 635,841 and U.S. Pat. No. 3,622,318.

In addition, either emulsions of the kind which form at the surface of the grains latent image to a very appreciable extent or emulsions of the kind which form latent images inside the grains may be employed.

These photographic emulsions are described in C. E. K. Mees, *The Theory of Photographic Process,* Macmillan, New York; P. Glafkides, *Chimie Photographique,* Paul Montel, Paris (1957); and so on, and can be prepared using generally accepted methods as described in P. Glafkides, *Chimie et Physique Photographique,* Paul Montel, Paris (1967); G. F. Duffin, *Photographic Emulsion Chemistry,* The Focal Press, London (1966); V. L. Zelikman et al., *Making and Coating Photographic Emulsion,* The Focal Press, London (1964); and so on. That is, the acid process, the neutral process, the ammonia process or other any known processes may be adopted. The reaction of soluble silver salts and soluble halogenides may be carried out using the single jet method, the double jet method or a combination thereof.

Also, the method in which silver halide grains are produced in the presence of excess silver ion (the so-called reverse mixing method) can be employed. In addition, the so-called controlled double jet method, in which the pAg of the liquid phase in which silver halide grains are to be precipitated is maintained constant, may be employed. According to this method, a silver halide emulsion containing grains having a regular crystal form and nearly uniform grain sizes can be obtained.

A mixture of two or more silver halide emulsions prepared separately may be employed.

In a process of producing silver halide grains or allowing the produced silver halide grains to ripen physically, cadmium salts, zinc salts, thallium salts, iridium salts or complexes, rhodium salts or complexes, iron salts or complexes and/or the like may be present.

The water-soluble salts are usually removed from the emulsions after the production of grains or the physical ripening process. For this purpose, the noodle washing method in which washing is carried out under the condition that gelatin is gelled, or a flocculation method using inorganic salts containing a polyvalent anion (e.g., ammonium sulfate), anionic surface active agents, anionic polymers (e.g., polystyrene sulfonic acid), or gelatin derivatives (e.g., aliphatic or aromatic acylated gelatins, aromatic carbamoylated gelatins, etc.) can be employed. The process of removing water-soluble salts from the emulsions may be omitted.

The silver halide emulsions are usually subjected to chemical sensitization, though chemically unsensitized (the so-called primitive) emulsions can also be used. Conventionally employed chemical sensitization techniques which can be used in this invention include those described in P. Glafkides, supra, V. L. Zelikman, et al., supra, and H. Frieser, *Die Grundlagen der Photographischen Prozesse mit Silberhalogeniden,* Akademische Verlagsgesellschaft (1968). Namely, sulfur sensitization techniques using compounds containing sulfur reactive with silver ion, or active gelatins; reduction sensitization techniques using reductive compounds; sensitization techniques using gold or other noble metal compounds; and so on can be employed individually or in combination thereof.

The photographic materials can preferably contain various kinds of additives for the purpose of obtaining desired developing characteristics, image characteristics, film properties and so on. Examples of such additives include iodides of a salt form, e.g., iodides of alkali metals, free mercapto group-containing organic compounds like phenylmercaptotetrazole, and so on. However, it is desirable to avoid adding large amounts of these additives.

The photographic materials may further contain a wide variety of compounds for purposes of raising the sensitivity, increasing the contrast and accelerating development. Specifically, polyalkylene oxides or their derivatives such as ethers, esters, amines and so on; thioether compounds; thiomorpholines; quaternary ammonium salt compounds; urethane derivatives; urea derivatives; imidazole derivatives; 3-pyrazolidones; and so on may be contained therein. More specifically, those which are described in U.S. Pat. Nos. 2,400,532, 2,423,549, 2,716,062, 3,617,280, 3,772,021 and 3,808,003, British Pat. No. 1,488,991, and so on can be employed as the above-described compounds.

To light-sensitive silver halide emulsion layers and light-insensitive auxiliary layers of photographic materials, it is conventional to add antifogging agents with preferable examples including heterocyclic organic compounds such as tetrazole, azaindene, triazoles, aminopurine and the like.

Besides the above-described additives, the photographic materials may contain a hardener, a plasticizer, a lubricant, a surface agent, a brightener and other additives known in the photographic art.

As for the binder or the protective colloid of the photographic emulsion, gelatin is used to advantage. However, other hydrophilic colloids can also be employed.

Suitable examples of such hydrophilic colloids include proteins such as gelatin derivatives, graft-polymers of gelatin and other macromolecular compounds, albumin, casein and the like; sugar derivatives such as cellulose derivatives (e.g., hydroxyethyl cellulose, carboxymethyl cellulose, cellulose sulfates, etc.), sodium alginate, starch derivatives and the like; and various kinds of synthetic hydrophilic homo- or copolymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole and the like.

Gelatin which can be employed in this invention includes not only lime-processed gelatin but also acid-processed gelatin and enzyme-processed gelatin as described in *Bull. Soc. Sci. Phot. Japan,* No. 16, p. 30 (1966). Further, hydrolysis products of gelatin and enzymatic degradation products of gelatin can also be employed.

Gelatin derivatives which can be employed in this invention include reaction products of gelatin with various kinds of compounds such as acid halides, acid anhydrides, isocyanates, bromoacetic acid, alkane sultones, vinyl sulfonamides, maleimido compounds, polyalkylene oxides, epoxy compounds and so on. Specific examples thereof are described in U.S. Pat. Nos. 2,614,928, 3,132,945, 3,186,846 and 3,312,553, British Pat. Nos. 861,414, 1,033,189 and 1,005,784, Japanese Patent Publication No. 16845/67, and so on.

Polymer grafted gelatins which can be employed in this invention include those which are obtained by grafting homo- or copolymers of vinyl monomers, such as acrylic acid, methacrylic acid, esters thereof, amides thereof, acrylonitrile, styrene and the like, on gelatin. In particular, graft polymers prepared from gelatin and polymers which are compatible with gelatin to some degrees, such as polymers of acrylic acid, methacrylic acid, acrylamide, methacrylamide, hydroxyalkylmethacrylate and/or the like, are preferably employed. Examples of these graft polymers are described in U.S. Pat. Nos. 2,763,625, 2,831,767, 2,956,884, and so on.

Typical examples of synthetic hydrophilic polymers which can be used in this invention include those which are described in German Patent Application (OLS) No. 2,312,708, U.S. Pat. Nos. 3,620,751 and 3,879,205, and Japanese Patent Publication No. 7561/68.

The photographic emulsions to be used in this invention can optionally be spectrally sensitized using cyanine dyes, such as cyanine, merocyanine, carbocyanine and the like, individually or in a form of combination, or using combinations of such cyanine dyes with styryl dyes and so on.

The photographic material to be used in this invention has at least one silver halide emulsion layer on a support and generally it has on a support a red-sensitive silver halide emulsion layer, a green-sensitive silver halide emulsion layer and a blue-sensitive silver halide emulsion layer. On occasion, it may have on a support a red-sensitive silver halide emulsion layer containing a cyan image forming coupler, a green-sensitive silver halide emulsion layer containing a magenta image forming coupler, and a blue-sensitive silver halide emulsion layer containing a yellow image forming coupler.

In hydrophilic colloidal layers of the photographic material to be used in this invention, water-soluble dyes may be contained as a filter dye, or for preventing irradiation and other various purposes. Specific examples of such water-soluble dyes include oxonol dyes, hemioxonol dyes, styryl dyes, merocyanine dyes, cyanine dyes and azo dyes. Among these dyes, oxonol dyes, hemioxonol dyes and merocyanine dyes are more useful.

Hydrophilic colloidal layers of the photographic material to be used in this invention may contain ultraviolet absorbing agents. For example, benzotriazole compounds substituted with aryl groups, 4-thiazolidone compounds, benzophenone compounds, cinnamate compounds, butadiene compounds, benzoxazole compounds, and ultraviolet absorbing polymers can be employed as such agents. These ultraviolet absorbing agents may be fixed in the above-described hydrophilic colloidal layers.

Photographic emulsion layers and other hydrophilic colloidal layers of the photographic material to be used in this invention may contain brightening agents of stilbene type, triazine type, oxazole type or coumarine type. These agents may have solubilities to water, or water-insoluble brightening agents may be used in the form of a dispersion.

On the occasion that dyes and ultraviolet absorbing agents are contained in hydrophilic colloidal layers of the photographic material to be used in this invention, they may be mordanted with cationic polymers or the like. For such a purpose, polymers described in British Pat. No. 685,475, U.S. Pat Nos. 2,675,316, 2,839,401, 2,882,156, 3,048,487, 3,184,309 and 3,445,231, German Patent Application (OLS) No. 1,914,362, Japanese Patent Application (OPI) Nos. 47624/75 and 71332/75, and so on can be used.

The sensitive material to be used in this invention may contain as a color fog inhibitor hydroquinone derivatives, aminophenol derivatives, gallic acid derivatives, ascorbic acid derivatives or the like.

In the photographic material to be used in this invention, the following known discoloration inhibitors and additionally color image stabilizer can be used independently or in combination of two or more thereof. Examples of known discoloration inhibitors include hydroquinone derivatives, gallic acid derivatives, p-alkoxyphenols, p-oxyphenol derivatives, bisphenols and so on.

Various kinds of surface active agents can be added to the photographic emulsion layers or other hydrophilic colloidal layers of the sensitive material to be used in this invention for various purposes. For example, the agents may be used as a coating aid, an antistatic agent, for improvement in slippability, emulsifying a dispersion, prevention of the generation of adhesion, improvement in the photographic characteristics (e.g., development acceleration, formation of highly contrast image, sensitization, etc.) and so on.

Examples of suitable surface active agents include nonionic surface active agents such as saponin (of steroid type), alkylene oxide derivatives (e.g., polyethylene glycol, polyethylene glycol/polypropylene glycol condensate, polyethylene glycol alkyl ethers or polyethylene glycol alkyl aryl ethers, polyethylene glycol esters, polyethylene glycol sorbitan esters, polyalkylene glycol alkylamines or amides, adducts of silicone and polyethylene oxides, etc.), glycidol derivatives (e.g., alkenylsuccinic acid polyglycerides, alkylphenol polyglyceride, etc.), fatty acid esters of polyhydric alcohols, alkyl esters of sugars, and so on; anionic surface active agents containing acidic groups (e.g., carboxy group, sulfo group, phospho group, sulfate group, phosphate group and the like), such as alkyl carboxylates, alkyl sulfonates, alkylbenzenesulfonates, alkylnaphthalenesulfonates, alkyl sulfates, alkyl phosphates, N-acyl-N-alkyltaurines, sulfosuccinates, sulfoalkylpolyoxyethylene alkyl phenyl ethers, polyoxyethylene alkylphosphates and so on; amphoteric surface active agents such as amino acids, aminoalkylsulfonic acids, aminoalkylsulfates or aminoalkylphosphates, alkylbetaines, amine oxides and so on; and cationic surface active agents such as alkylamine salts, aliphatic or aromatic quaternary ammonium salts, heterocyclic quaternary ammonium salts like pyridinium, imidazolium and so on, aliphatic or heterocyclic ring-containing phosphonium or sulfonium salts, and so on.

The photographic emulsion layers and other hydrophilic colloidal layers of the photographic material to be used in this invention may contain inorganic or organic hardeners. For example, chromium salts (e.g., chrome alum, chromium acetate, etc.), aldehydes (e.g., formaldehyde, glyoxal, glutaraldehyde, etc.), N-methylol compounds (e.g., dimethylol urea, methylol dimethylhydantoin, etc.), dioxane derivatives (e.g., 2,3-dihydroxydioxane, etc.), active vinyl-containing compounds (e.g., 1,3,5-triacryloyl-hexahydro-s-triazine, 1,3-vinylsulfonyl-2-propanol, etc.), active halogen-containing compounds (e.g., 2,4-dichloro-6-hydroxy-s-triazine, etc.), mucohalogenic acids (e.g., mucochloric acid, mucophenoxychloric acid, etc.) and so on can be used individually or in combination.

The photographic emulsion layers and other hydrophilic colloidal layers of the photographic material to be used in this invention can contain dispersions of water-insoluble or slightly soluble synthetic polymers for the purpose of the improvement in dimensional stabilization and so on. Suitable examples of such polymers include those which have as constituent monomer(s) alkyl(meth)acrylate, alkoxyalkyl(meth)acrylate, glycidyl(meth)acrylate, (meth)acrylamide, vinyl ester (e.g., vinyl acetate), acrylonitrile, olefin, styrene and so on independently or in combination of two or more thereof, or combinations of these monomers with acrylic acid, methacrylic acid, $\alpha,\beta$-unsaturated dicarboxylic acid, hydroxyalkyl(meth)acrylate, sulfoalkyl(meth)-acrylate, styrenesulfonic acid or/and so on.

The process of this invention can be applied to multilayer color photographic materials having on a support at least two different spectral sensitivities. A multilayer color photographic material generally has on a support at least one red-sensitive emulsion layer, at least one green-sensitive emulsion layer and at least one blue-sensitive emulsion layer. The order of these layers on the support can be properly chosen as occasion calls. It is general to incorporate a cyan forming coupler in a red-sensitive emulsion layer, a magenta forming coupler in a green-sensitive emulsion layer, and a yellow forming coupler in a blue-sensitive emulsion layer. However, some different combination can also be employed depending on circumstances.

A photographic element to be employed in this invention may consist of one emulsion layer constituted with plural unit emulsions, or may have a multilayer structure constructed by various layers.

Examples of photographic supports include those which are conventionally used for photographic materials, such as a cellulose nitrate film, a cellulose acetate film, a cellulose acetate butyrate film, a cellulose acetate propionate film, a polyethylene film, a polyethylene terephthalate film, a polycarbonate film, laminates of some of these films, thin glass plates, paper and so on. Particularly, baryta-coated paper, paper coated or laminated with α-olefin resin, especially those having as constituent monomer(s) α-olefin(s) having 2 to 10 carbon atoms, such as polyethylene, polypropylene, ethylene-butene copolymer, etc., or plastic films the surfaces of which are rendered rough to improve in adhesiveness to other macromolecular substances, as described in Japanese Patent Publication No. 19068/72, lead to good results.

The supports can be either transparent or opaque, depending on the end-use purposes of the photographic materials. In the case of transparent supports, they may be colorless or colored by addition of dyes or pigments thereto. Colored transparent films have so far been employed in the art of X-ray films as disclosed in J. SMPTE., Vol. 67, p. 296 (1958), and so on.

Opaque supports include not only those which are opaque by nature, such as paper, but also transparent films to which dyes, pigments like titanium oxide, or the like are added, plastic films having received such surface treatments as described in published Japanese Patent Publication No. 19068/72, and paper or plastic films to which carbon black, dyes or the like are added so as to completely shield the light.

Layers having adhesiveness to both supports and photographic emulsion layers may be provided as subbing layers. On the other hand, supports may receive pretreatments to improve the adhesiveness of their surfaces to photographic emulsion layers, for example, a corona discharge treatment, an ultraviolet irradiation treatment, a flame treatment and the like.

The photographic material to be used in this invention is comprised of a support and a photographic element comprising a dye image providing unit layers. The multicolor photographic material has at least two dye image providing unit layers described above, and the unit layers record firstly spectral light in separate positions. The unit layer contains a light-sensitive silver salt, which is, in general, spectrally sensitized and responds to spectral light in its specific position and that, associates therewith a photographic color coupler. The color providing layer is efficiently isolated by a separating layer, a spacing layer, a layer containing a scavenger for oxidation products of developing agents, and so on in order to prevent any color contaminations from occurring among the dye image providing unit layers. Efficient isolation techniques of the unit layer are well-known in this art, and utilized for prevention of contamination in many commercial color photographic films.

Two or more of layers may be coated at the same time, if desired, using methods described in U.S. Pat. Nos. 2,761,791, 3,508,947 and 837,095. The unit layers may be so designed as to be used for color image transfer processes as described in U.S. Pat. Nos. 3,087,817, 3,185,567, 2,983,606, 3,253,915, 3,227,550, 3,227,551, 3,227,552, 3,145,633, 3,415,645 and 3,415,646, or for absorption transfer processes as described in U.S. Pat. No. 2,828,156. On the occasion that dye pre-forming couplers or redox dissociative couplers are employed in sensitive materials, at least two color providing unit layers must contain these couplers in amounts more than the stoichiometric ones determined on a basis of silver contents therein by at least 40%.

An intensifying solution to be employed in this invention contains one or more intensifiers selected from the aforementioned intensifiers and, additionally, can contain constituent compounds of known intensifying solutions. For example, a pH buffering agent, an antifoggant, a stabilizer for the intensifier used, and so on can be added to the intensifying solution. In addition, a development accelerator, a preservative, a water softener, an organic solvent, a dye forming coupler, a competing coupler, a fogging agent, an assistant developer, a viscosity imparting agent, a chelating agent of polycarboxylic acid type, an antioxidizing agent, an alkali agent, a dissolving aid, a surface active agent, a defoaming agent and so on may be contained in the intensifying solution.

Specific examples of these additives are described in German Patent Application (OLS) No. 1,813,920, Japanese Patent Application (OPI) Nos. 9728/73, 13335/77 (U.S. Pat. No. 4,062,684) and 73731/77, and so on.

In a representative process of this invention, a silver halide color sensitive material is subjected to, in sequence, imagewise exposure, a combined developing and intensifying processing, the treatment of this invention using a dilute solution adjusted to pH 2 to 7 by containing a buffer, water washing and drying, resulting in the formation of a dye image. It is possible to eliminate the water washing step in the above process. It is more advantageous to introduce the treatment of this invention to the process of this invention after the combined developing and intensifying processing preferably using a peroxide as an intensifier.

In another process, latent image is made to grow by development and, subsequently, a color developing agent is held in the constituent layers of the sensitive film, the resulting sensitive film is subjected to image intensification using both an intensifying solution and the developing agent brought into the intensifying bath in a state that it is held in the sensitive film and, further, the resulting sensitive film is treated with a dilute buffer solution adjusted to pH 2 to 7.

In still another process, a developing agent is incorporated in a sensitive material, for example, in an emulsion layer, and the sensitive material is processed in an alkaline intensifying solution to form an intensified image, followed by the above-described after-treatment.

In a further process, a coupler is added to a developing and intensifying solution and therein a sensitive material is processed to form an intensified image and then the sensitive material is treated with the dilute processing solution of this invention. The so-called diffusible in-developer type couplers which can be used in the developing and intensifying solution include those which function as cyan couplers, as described in U.S. Pat. Nos. 3,002,836, 3,542,552 and so on; those which function as magenta couplers, as described in Japanese Patent Publication No. 13111/69 and so on; and those which function as yellow couplers, as described in U.S. Pat. No. 3,510,306 and so on. In this process, a preferable concentration of such a coupler ranges from 0.5 to 5 g/l, particularly from 1 to 2.5 g/l.

In another process, a sensitive layer and an image receiving layer are superposed upon each other and therebetween a developing and intensifying solution is present to cause development and intensification at the same time. Thereupon, the dye becomes mobile through oxidation with the intensifier, and diffuses into the image receiving layer. Contrary to the above-described case, it is also possible to diffuse a mobile dye present in the unoxidized part of the sensitive layer into the image receiving layer. After forming a color image in the above-described manner, the image receiving layer is treated with the dilute buffer solution of this invention.

In every process described above, water washing may be carried out after the processing of this invention, or it may be omitted because even if it is omitted no significant problems are caused.

The exposure for obtaining a photographic image may be carried out in a conventional manner. Any various known light sources including natural light (sun light), a tungsten lamp, a fluorescent lamp, a mercury lamp, a xenon arc lamp, a carbon arc lamp, a xenon flash lamp, cathode-ray tube flying spot and so on can be employed for the exposure. Suitable exposure times which can be used include not only exposure times commonly used in cameras ranging from about 1/1,000 to about 1 second, but also exposure times shorter than 1/1,000 second, for example, about $1/10^4$ to about $1/10^6$ second as used with xenon flash lamps and cathode-ray tubes. Exposure times longer than 1 second can also be used. The spectral distribution of the light used for the exposure can be controlled using color filters, if desired. Laser beams can also be employed for the exposure. Moreover, the sensitive materials may also be exposed to light emitted from phosphorus excited by electron beams, X-rays, $\gamma$-rays, $\alpha$-rays and the like.

The process of this invention exhibits a great effect, particularly when applied to the monobath development processing method described in Japanese Patent Application No. 117973/81.

EXAMPLE 1

On a paper support both sides of which were laminated with a titanium dioxide-dispersed polyethylene film were coated the following layers, from the first layer (the lowest layer) to the sixth layer (the topmost layer), to prepare a low silver content color sensitive material. (In the following table, the term mg/m$^2$ represents the coverage.)

| | |
|---|---|
| The 6th layer | Gelatin (1,000 mg/m$^2$) |
| The 5th layer (red-sensitive layer) | Silver chlorobromide emulsion (silver bromide content: 30 mole %, silver: 5 mg/m$^2$, mean grain size: 0.2$\mu$)<br>Gelatin (1,000 mg/m$^2$)<br>Cyan coupler*1 (400 mg/m$^2$)<br>Coupler solvent*2 (200 mg/m$^2$) |
| The 4th layer | Gelatin (1,200 mg/m$^2$)<br>Ultraviolet absorbing agent*3 (1,000 mg/m$^2$)<br>Dioctylhydroquinone (50 mg/m$^2$) |
| The 3rd layer (green-sensitive layer) | Silver chlorobromide emulsion (silver bromide content: 30 mole %, silver: 5 mg/m$^2$, mean grain size: 0.2$\mu$)<br>Gelatin (1,000 mg/m$^2$)<br>Magenta coupler*4 (300 mg/m$^2$)<br>Coupler solvent*5 (300 mg/m$^2$) |
| The 2nd layer | Gelatin (1,000 mg/m$^2$) |
| The 1st layer (blue-sensitive layer) | Silver chlorobromide emulsion (silver bromide content: 80 mole %, silver: 8 mg/m$^2$, mean grain size: 0.4$\mu$)<br>Gelatin (1,200 mg/m$^2$) |

-continued

| | |
|---|---|
| | Yellow coupler*6 (300 mg/m$^2$)<br>Coupler solvent*2 (150 mg/m$^2$) |
| Support | |

| | |
|---|---|
| *1Cyan coupler: | 2-[$\alpha$-(2,4-Di-t-amylphenoxy)-butanamido]-4,6-dichloro-5-methylphenol |
| *2Coupler solvent: | n-Butyl phthalate |
| *3Ultraviolet absorbing agent: | 2-(2-Hydroxy-3-sec-butyl-5-t-butylphenyl)benzotriazole |
| *4Magenta coupler: | 1-(2,4,6-Trichlorophenyl)-3-(2-chloro-5-tetradecanamido)anilino-2-pyrazoline-5-one |
| *5Coupler solvent: | o-Cresylphosphate |
| *6Yellow coupler: | $\alpha$-Pivaroyl-$\alpha$-2,4-dioxo-5,5'-dimethyloxazolidine-3-yl-2-chloro-5-[$\alpha$-(2,4-di-t-amylphenoxy)-butanamido]acetanilide |

The above-described sample was exposed to light using a sensitometer and subsequently subjected to the following processings.

| Processings | Temperature | Time |
|---|---|---|
| Combined development and intensification | 35° C. | 1 min |
| After-treatment | 35° C. | 30 sec |

The processing solutions used had the following compositions.

| | | |
|---|---|---|
| Combined Developing and Intensifying Bath | | |
| Potassium sulfite | | 4 g |
| Tripotassium phosphate | | 40 g |
| Dipotassium phosphate | | 6 g |
| 1-Hydroxyethane-1,1-diphosphonic acid | | 2 g |
| Benzotriazole | | 6 mg |
| 4-Amino-3-methyl-N—ethyl-N—$\beta$-(methanesulfonamido)ethylaniline.3/2 sulfate | | 4 g |
| Hydrogen peroxide (30%) | | 20 ml |
| Water to make | | 1 l<br>(pH 11.0) |
| After-Treating Solution | | |
| No. 1 | 0.1 N Hydrochloric acid | 350 ml |
| | Sodium citrate dihydrate | 4.4 g |
| | Water to make | 1 l<br>(pH 3.2) |
| No. 2 | 0.1 N Hydrochloric acid | 110 ml |
| | Sodium citrate dihydrate | 4.1 g |
| | Water to make | 1 l<br>(pH 5.3) |
| No. 3 | Sodium sulfite | 2.5 g |
| | Sodium bisulfite | 3.0 g |
| | Water to make | 1 l<br>(pH 6.7) |
| No. 4 | Sodium sulfite | 2.5 g |
| | Sodium bisulfite | 3.0 g |
| | Sodium thiosulfate | 1.6 g |
| | Water to make | 1 l<br>(pH 6.7) |
| No. 5 | Monopotassium phosphate | 3.5 g |
| | Dipotassium phosphate | 4.1 g |
| | Sodium thiosulfate | 1.0 g |
| | Water to make | 1 l<br>(pH 6.7) |

In addition, the following processings were carried out for comparison.

| Processings | Temperature | Time |
|---|---|---|
| Combined development and intensification | 35° C. | 1 min |
| Water washing | 25° C. | 30 sec |

-continued

| Processings | Temperature | Time |
|---|---|---|
| (running water) | | or 2 min |

In every case, the sample was dried after the final processing, and the minimum density ($D_{min}$) thereof was measured. Results obtained are shown in Table 1.

TABLE 1

| After Treatment | | $D_{min}$ (B) | $D_{min}$ (G) | $D_{min}$ (R) |
|---|---|---|---|---|
| No. 1 | This invention | 0.13 | 0.13 | 0.09 |
| No. 2 | " | 0.17 | 0.15 | 0.12 |
| No. 3 | " | 0.15 | 0.13 | 0.11 |
| No. 4 | " | 0.11 | 0.11 | 0.08 |
| No. 5 | " | 0.10 | 0.11 | 0.07 |
| Water washing for 30 sec | Comparison | 0.40 | 0.30 | 0.23 |
| Water washing for 2 min | " | 0.26 | 0.22 | 0.17 |

As can be seen from Table 1, low $D_{min}$ values were attained for a very short time by using the processings of this invention. However, it took a long time to attain such low $D_{min}$ values using only the conventional water washing processing. In addition, stains are hardly observed on the surface of the sensitive material after the drying processing.

EXAMPLE 2

On a paper support both sides of which are laminated with a titanium dioxide-dispersed polyethylene film were coated the following first and second layers to prepare a photographic element.

| | |
|---|---|
| The 2nd layer | Gelatin (1,000 mg/m$^2$) |
| The 1st layer | Silver chlorobromide emulsion (silver bromide content: 30 mole %, silver: 20 mg/m$^2$, mean grain size: 0.2μ) |
| | Gelatin (1,000 mg/m$^2$) |
| | Coupler dispersed in o-cresylphosphate: 1-(2,4,6-trichlorophenyl)-3-(2-chloro-5-tetradecanamido)anilino-2-pyrazoline-5-one (300 mg/m$^2$) |
| Support | |

The above-described sample was exposed to light using a sensitometer and, subsequently, subjected to the following processings.

| Processings | Temperature | Time |
|---|---|---|
| Process (I) | | |
| Color development | 40° C. | 1 min |
| Intensification (A) to (D) | 40° C. | 1 min |
| After-treatment | 40° C. | 30 sec |
| Process (II) | | |
| Color development | 40° C. | 1 min |
| Intensification (A) to (D) | 40° C. | 1 min |
| Water washing | 25–40° C. | 30 sec or 2 min |

The processing solutions used had the following compositions.

| | |
|---|---|
| Color Developing Solution | |
| Benzyl alcohol | 15 ml |

-continued

| | |
|---|---|
| Sodium sulfite | 5 g |
| Potassium bromide | 0.4 g |
| Potassium carbonate | 30 g |
| Hydroxylamine sulfate | 3 g |
| Diethylenetriaminepentaacetic acid | 5 g |
| 4-Amino-3-methyl-N—ethyl-β-(methanesulfonamido)ethylaniline.3/2 sulfate monohydrate | 10 g |
| Potassium hydroxide | 1.2 g |
| Water to make | 1 l |
| | (pH 10.1) |
| Intensifying Solution (A) | |
| Hydrogen peroxide (30%) | 30 ml |
| Sodium carbonate monohydrate | 20 g |
| 5-Methylbenzotriazole | 100 mg |
| 1-Hydroxyethane-1,1-diphosphonic acid | 2 g |
| Water to make | 1 l |
| | (pH 10.0) |
| Intensifying Solution (B) | |
| Benzyl alcohol | 15 ml |
| Cobalt hexaamminechloride | 10 g |
| Potassium carbonate | 10 g |
| Potassium sulfite | 2 g |
| Potassium bromide | 2 g |
| Diethylenetriaminepentaacetic acid | 10 g |
| Water to make | 1 l |
| | (pH 10.1) |
| Intensifying Solution (C) | |
| Sodium carbonate monohydrate | 25 g |
| Sodium bicarbonate | 6 g |
| o-Iodosobenzoic acid | 4 g |
| 5-Nitrobenzimidazole | 200 mg |
| Water to make | 1 l |
| | (pH 10.0) |
| Intensifying Solution (D) | |
| Sodium chlorite | 20 g |
| 5-Nitrobenzimidazole | 200 mg |
| Sodium carbonate | 10 g |
| Diethylenetriaminepentaacetic acid | 2 g |
| Water to make | 1 l |
| | (pH 10.1) |
| After-Treating Solution | |
| 0.1 N Hydrochloric acid | 350 ml |
| Sodium citrate dihydrate | 4.4 g |
| Water to make | 1 l |
| | (pH 3.2) |

The samples processed in accordance with the process (I) and the process (II), respectively, were dried, and the minimum density ($D_{min}$) of magenta in each of the samples was measured. Results obtained are shown in Table 2.

TABLE 2

| Intensifying Solution | Process | | $D_{min}$ |
|---|---|---|---|
| (A) | (I) | This invention | 0.11 |
| | (II) Washing for 30 sec | Comparison | 0.22 |
| | (II) Washing for 2 min | This invention | 0.15 |
| | | Comparison | |
| (B) | (I) | This invention | 0.13 |
| | (II) Washing for 30 sec | Comparison | 0.25 |
| | (II) Washing for 2 min | This invention | 0.16 |
| | | Comparison | |
| (C) | (I) | This invention | 0.12 |
| | (II) Washing for 30 sec | Comparison | 0.23 |
| | (II) Washing for 2 min | This invention | 0.16 |
| | | Comparison | |
| (D) | (I) | This invention | 0.10 |
| | (II) Washing for 30 sec | Comparison | 0.21 |
| | (II) Washing for 2 min | This invention | 0.15 |
| | | Comparison | |

As can be ssen from Table 2, the processing required a long time to be effective when water washing alone was employed. However, washing was effective in a very short time by using the after-treatment of this invention, and provided low $D_{min}$ values. In addition, stains were hardly caused on the surface of the sensitive material after receiving the drying processing.

EXAMPLE 3

The same low silver content color sensitive material as described in Example 1 was prepared.

The thus-prepared sample was exposed to light using a sensitometer and subsequently subjected to the following processings.

| Processings | Temperature | Time |
|---|---|---|
| Combined development and intensification | 35° C. | 1 min |
| After-treatment | 35° C. | x sec (x = 5, 10, 20, 30) |

The processing solutions used had the following compositions.

| | | |
|---|---|---|
| Combined Developing and Intensifying Bath | | |
| Potassium sulfite | | 4 g |
| Tripotassium phosphate | | 40 g |
| Dipotassium phosphate | | 6 g |
| 1-Hydroxyethane-1,1-diphosphonic acid | | 2 g |
| Benzotriazole | | 6 mg |
| 4-Amino-3-methyl-N—ethyl-N—β-(methanesulfonamido)ethylaniline.3/2 sulfate | | 4 g |
| Hydrogen peroxide (30%) | | 20 ml |
| Water to make | | 1 l (pH 11.0) |
| After-Treating Solution | | |
| No. 1 | Monopotassium phosphate | 3.5 g |
| | Dipotassium phosphate | 4.1 g |
| | Water to make | 1 l (pH 6.7) |
| No. 2 | Solution No. 1 to which 1.6 g of Compound (1) was added. | |
| No. 3 | Solution No. 1 to which 2 g of Compound (18) was added. | |
| No. 4 | Solution No. 1 to which 2 g of the hydrochloride of Compound (29) was added. | |
| No. 5 | Solution No. 1 to which 2 g of Compound (39) was added. | |
| No. 6 | Sodium sulfite | 2.5 g |
| | Sodium bisulfite | 3.0 g |
| | Water to make | 1 l (pH 6.7) |
| No. 7 | Solution No. 6 to which 1.6 g of Compound (1) was added. | |
| No. 8 | Solution No. 6 to which 2 g of Compound (18) was added. | |
| No. 9 | Solution No. 6 to which 2 g of the hydrochloride of Compound (29) was added. | |
| No. 10 | Solution No. 6 to which 2 g of Compound (39) was added. | |

Compounds (1), (18), (29) and (39) are recited before as the compound capable of depressing the intensifying activity of silver halide fog nuclei.

In every case, the sample was dried following the after-treatment, and the minimum density ($D_{min}$) thereof was measured. Results obtained are shown in Table 3.

TABLE 3

| After-Treating Solution No. | X = 5 | | | X = 10 | | | X = 20 | | | X = 30 | | |
|---|---|---|---|---|---|---|---|---|---|---|---|---|
| | $D_{min}$ (B) | $D_{min}$ (G) | $D_{min}$ (R) | $D_{min}$ (B) | $D_{min}$ (G) | $D_{min}$ (R) | $D_{min}$ (B) | $D_{min}$ (G) | $D_{min}$ (R) | $D_{min}$ (B) | $D_{min}$ (G) | $D_{min}$ (R) |
| 1 | 0.40 | 0.30 | 0.23 | 0.26 | 0.26 | 0.19 | 0.20 | 0.18 | 0.14 | 0.19 | 0.17 | 0.13 |
| 2 | 0.14 | 0.12 | 0.08 | 0.14 | 0.13 | 0.09 | 0.13 | 0.12 | 0.08 | 0.13 | 0.11 | 0.07 |
| 3 | 0.17 | 0.15 | 0.11 | 0.13 | 0.13 | 0.09 | 0.12 | 0.12 | 0.08 | 0.12 | 0.12 | 0.08 |
| 4 | 0.22 | 0.20 | 0.16 | 0.19 | 0.19 | 0.15 | 0.17 | 0.17 | 0.13 | 0.15 | 0.15 | 0.12 |
| 5 | 0.35 | 0.26 | 0.18 | 0.19 | 0.18 | 0.12 | 0.11 | 0.13 | 0.09 | 0.11 | 0.13 | 0.09 |
| 6 | 0.30 | 0.25 | 0.21 | 0.21 | 0.20 | 0.17 | 0.16 | 0.14 | 0.12 | 0.15 | 0.13 | 0.11 |
| 7 | 0.11 | 0.12 | 0.10 | 0.10 | 0.12 | 0.10 | 0.10 | 0.12 | 0.09 | 0.10 | 0.12 | 0.09 |
| 8 | 0.14 | 0.14 | 0.11 | 0.13 | 0.12 | 0.09 | 0.12 | 0.12 | 0.09 | 0.12 | 0.12 | 0.09 |
| 9 | 0.10 | 0.13 | 0.09 | 0.10 | 0.12 | 0.09 | 0.09 | 0.11 | 0.09 | 0.09 | 0.11 | 0.08 |
| 10 | 0.12 | 0.13 | 0.11 | 0.12 | 0.12 | 0.10 | 0.10 | 0.12 | 0.09 | 0.09 | 0.11 | 0.09 |

As can be seen from Table 3, low $D_{min}$ values were achieved for shorter times using the after-treating solutions No. 2 to No. 5, compared with the after-treating solution No. 1, and using the after-treating solutions No. 7 to No. 10, compared with the after-treating solution No. 6. It should also be noted that no changes in gradation and maximum density ($D_{max}$) were caused by the after-treatment of this invention.

EXAMPLE 4

The same low silver content color sensitive material as described in Example 1 was prepared.

The thus-prepared sample was exposed to light using a sensitometer and subsequently subjected to the following processings.

| Processings | Temperature | Time |
|---|---|---|
| Combined development and intensification | 35° C. | 1 min |
| After-treatment | 35° C. | 30 sec |

The processing solutions used had the following compositions.

| | | |
|---|---|---|
| Combined Developing and Intensifying Bath | | |
| Potassium sulfite | | 4 g |
| Tripotassium phosphate | | 40 g |
| Dipotassium phosphate | | 6 g |
| 1-Hydroxyethane-1,1-diphosphonic acid | | 2 g |
| Benzotriazole | | 6 mg |
| 4-Amino-3-methyl-N—ethyl-N—β-(methanesulfonamido)ethylaniline.3/2 sulfate | | 4 g |
| Hydrogen peroxide (30%) | | 20 ml |
| Water to make | | 1 l (pH 11.0) |
| After-Treating Solution | | |
| No. 1 | Sodium sulfite | 2.5 g |
| | Sodium bisulfite | 3.0 g |
| | Water to make | 1 l (pH 6.7) |
| No. 2 | Solution No. 1 to which 1.0 g of Compound (44) was added. | |
| No. 3 | Solution No. 1 to which 2.0 g of Compound (45) was added. | |
| No. 4 | Sodium sulfite | 2.5 g |
| | Sodium bisulfite | 3.0 g |
| | Sodium 2-mercaptobenzimidazole-5-sulfonate | 1.0 g |
| | Water to make | 1 l |

-continued

| | |
|---|---|
| | (pH 6.7) |
| No. 5 | Solution No. 4 to which 1.0 g of Compound (44) was added. |
| No. 6 | Solution No. 4 to which 1.0 g of Compound (53) was added. |

Compounds (44), (45) and (53) are recited before as the fluorescent brightening agent.

In every case, the sample was dried following the after-treatment, and the minimum density ($D_{min}$) of the exposed part thereof was measured through a blue filter. Results obtained are shown in Table 4.

TABLE 4

| After-Treating Solution No. | $D_{min}$ (B) |
|---|---|
| 1 | 0.16 |
| 2 | 0.11 |
| 3 | 0.10 |
| 4 | 0.13 |
| 5 | 0.09 |
| 6 | 0.08 |

As can be seen from Table 4, low $D_{min}$ values were achieved in the blue-sensitive layer by using the processing solutions containing fluorescent brightening agents. It should also be noted that there were little differences among maximum densities obtained using the after-treating solutions No. 1 to No. 6, respectively.

While the invention has been described in detail and with reference to specific embodiments thereof, it will be apparent to one skilled in the art that various changes and modifications can be made therein without departing from the spirit and scope thereof.

What is claimed is:

1. A process for forming a color image, comprising the steps of:

providing a light-sensitive silver halide color photographic material;

imagewise exposing the material in order to form a latent image;

subjecting the material to color development and intensification processing in order to develop the latent image and form a developed and intensified image, the color development and intensification processing being carried out in a combined developing and intensifying bath containing a compound selected from the group consisting of hydrogen peroxide and a compound capable of releasing hydrogen peroxide and a developing agent, said combined bath not containing substantially any bromide ion or any iodide ion, the combined bath further comprising at least one nitrogen-containing heterocyclic compound; and treating the material with a non-bleach, non-fix, dilute buffer solution containing a buffer agent and having a pH adjusted within the range of 2 to 7.

2. A process for forming a color image as claimed in claim 1, wherein the concentration of the buffer agent in the buffer solution ranges from $1\times10^{-2}$ mole to 1 mole per liter.

3. A process for forming a color image as claimed in claim 1, wherein the concentration of the buffer agent in buffer solution ranges from $1\times10^{-2}$ mole to $1\times10^{-1}$ mole per liter.

4. A process for forming a color image as claimed in claim 1, wherein the buffer solution is further comprised of a compound capable of depressing the intensifying activity of silver halide fog nuclei.

5. A process for forming a color image as claimed in claim 4, wherein the compound capable of depressing the intensifying activity of silver halide fog nuclei is present in the buffer solution in an amount of within the range of from $1\times10^{-5}$ to $2\times10^{-1}$ mole per liter of the buffer solution.

6. A process for forming a color image as claimed in claim 4, wherein the compound capable of depressing the intensifying activity of silver halide fog nuclei is present in the buffer solution in an amount of within the range of from $1\times10^{-3}$ to $5\times10^{-2}$ mole per liter of the buffer solution.

7. A process for forming a color image as claimed in claim 4, wherein the compound capable of depressing the intensifying activity of silver halide fog nuclei is selected from the group consisting of halides, azoles, heterocyclic mercapto compounds, thioether compounds, thiourea compounds, sulfur-containing amino acids, thioketo compounds, azaindenes, benzenethiosulfonic acids and benzenesulfinic acids.

8. A process for forming a color image as claimed in claim 1, wherein the buffer solution is further comprised of a fluorescent brightening agent.

9. A process for forming a color image as claimed in claim 8, wherein the fluorescent brightening agent is present in the buffer solution in an amount within the range of from $5\times10^{-5}$ to $5\times10^{-2}$ mole per liter of the buffer solution.

10. A process for forming a color image as claimed in claim 8, wherein the fluorescent brightening agent is present in the buffer solution in an amount within the range of from $1\times10^{-4}$ mole to $2\times10^{-2}$ mole per liter of the buffer solution.

11. A process for forming a color image as claimed in claim 8, wherein the fluorescent brightening agent is selected from the group consisting of diaminostilbene type, distyrylbenzene type, benzidine type, diaminocarbazole type, triazole type, imidazole, thiazole and oxazole type, imidazolone type, dihydropyridine type, coumarin and carbostyryl type, diaminodibenzothiophene dioxide type, diaminofluorene type, oxacyanine type, aminonaphthalimide type, pyrazoline type and oxadiazole type.

12. A process for forming a color image as claimed in claim 1, wherein the dilute buffer solution has a pH adjusted with the range of 2 to 5.

13. Process according to claim 1, wherein the nitrogen-containing heterocyclic compound is at least one compound selected from nigrogen-containing 5- or 6-membered heterocyclic compounds, condensed rings thereof, and nitrogen-containing heterocyclic compound represented by the following general formulae (I) and (II), respectively:

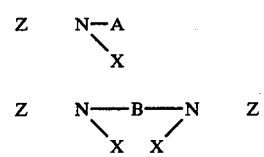

(I)

(II)

wherein A represents a substituted or unsubstituted alkyl group, an alkenyl group, an alkinyl group, an aralkyl group, an alicyclic hydrocarbon group, or a substituted or unsubstituted aryl group; B represents a substituted or unsubstituted divalent hydrocarbon residue. X represents an anion other than ion; and Z represents non-metal atoms necessary to form a heterocyclic ring together with nitrogen.

14. Process according to claim 13, wherein B is $-(CH_2)_n-$, $-CH_2O-(CH_2)_n-O-CH_2-$,

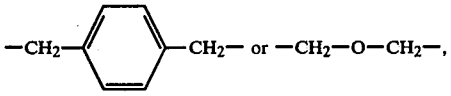

and n represents an integer of 1 to 12.

15. Process according to claim 1, wherein the nitrogen-containing heterocyclic compound is at least one compound which has a mercapto group in its individual molecule.

16. Process according to claim 15, wherein the compound having the mercapto group has the following general formula:

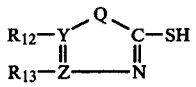

wherein Q represents an oxygen atom, a sulfur atom or —NR''' wherein R''' represents a hydrogen atom, an alkyl group, an unsaturated alkyl group, or a substituted or unsubstituted aryl or aralkyl group; Y and Z each represents a carbon atom or a nitrogen atom; and $R_{12}$ and $R_{13}$ each represents a hydrogen atom, an alkyl group, an unsaturated alkyl group, a substituted or unsubstituted aryl group, a substituted or unsubstituted aralkyl group, —SR'''' or $-NH_2$ wherein R'''' represents a hydrogen atom, an alkyl group, an aryl group, an aralkyl group, an alkylcarboxylic acid or an alkali metal salt thereof, or an alkylsulfonic acid or alkali metal salt thereof, and when both Y and Z are carbon atoms, $R_{12}$ and $R_{13}$ may form a substituted or unsubstituted aromatic ring.

17. Process according to claim 1, wherein the nitrogen-containing heterocyclic compound is at least one compound selected from nitrobenzimidazoles, benzotriazoles, heterocyclic quaternary salts, and tetraazaindenese.

* * * * *